US010582775B2

(12) United States Patent
Lee

(10) Patent No.: US 10,582,775 B2
(45) **Date of Patent: *Mar. 10, 2020**

(54) BED FRAME ASSEMBLED BY SLIDING THE ENDS OF METAL BARS INTO SLOTS CUT INTO OTHER METAL BARS

(71) Applicant: Zinus Inc., Tracy, CA (US)

(72) Inventor: Youn Jae Lee, Seongnam-si (KR)

(73) Assignee: Zinus Inc., Tracy, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/459,415

(22) Filed: Jul. 1, 2019

(65) Prior Publication Data

US 2019/0320804 A1 Oct. 24, 2019

Related U.S. Application Data

(63) Continuation of application No. 15/609,067, filed on May 31, 2017, now Pat. No. 10,362,879.

(51) Int. Cl.

| | |
|---|---|
| ***A47C 19/00*** | (2006.01) |
| ***A47C 19/02*** | (2006.01) |
| *A47C 19/20* | (2006.01) |

(52) U.S. Cl.

CPC ..... *A47C 19/005* (2013.01); *A47C 19/024* (2013.01); *A47C 19/025* (2013.01); *A47C 19/02* (2013.01); *A47C 19/202* (2013.01)

(58) Field of Classification Search

CPC ... A47C 19/005; A47C 19/024; A47C 19/025; A47C 19/202; A47C 19/02

See application file for complete search history.

(56) References Cited

U.S. PATENT DOCUMENTS

| | | | | |
|---|---|---|---|---|
| 2,203,780 A * | 6/1940 | Gatz | ..... | A47B 25/003 248/165 |
| 5,522,101 A * | 6/1996 | Yeh | ..... | A47C 19/005 403/334 |
| 5,694,656 A * | 12/1997 | Huang | ..... | A47C 19/005 5/290 |
| 6,983,494 B1 * | 1/2006 | Jannetides | ..... | A47C 15/002 5/2.1 |
| 8,136,183 B1 * | 3/2012 | Jannetides | ..... | A47C 19/005 5/282.1 |
| 8,359,985 B2 * | 1/2013 | Wangdak | ..... | A47B 47/042 108/158.12 |

(Continued)

*Primary Examiner* — Nicholas F Polito
*Assistant Examiner* — Rahib T Zaman
(74) *Attorney, Agent, or Firm* — Imperium Patent Works; Darien K. Wallace

(57) ABSTRACT

A novel bed frame is assembled by sliding the ends of hollow metal bars into narrow slots cut into other hollow metal bars. A first bar has an L-shaped first slot. A second bar has a U-shaped second slot and L-shaped third slot, both spanning two adjacent sides of the second bar. An end of the first bar is inserted into the U-shaped second slot, whose width is less than twice the thickness of the metal from which the first bar is made. A portion of the L-shaped first slot aligns with a portion of the L-shaped third slot when the first bar slides into the U-shaped second slot. The top of the third bar is inserted into the aligned first and third slots. The first bar is a longitudinal bar, and the second bar is a lateral bar of the bed frame. The third bar is a support leg.

20 Claims, 9 Drawing Sheets

(56) References Cited

U.S. PATENT DOCUMENTS

| | | | | |
|---|---|---|---|---|
| 8,869,324 | B1 * | 10/2014 | Lin | A47C 19/02 5/200.1 |
| 10,362,879 | B2 * | 7/2019 | Lee | A47C 19/005 |
| 2010/0018966 | A1 * | 1/2010 | Roberts, Sr. | B65D 19/18 220/4.31 |
| 2010/0093257 | A1 * | 4/2010 | Elliott | A47B 3/06 446/478 |
| 2011/0219537 | A1 * | 9/2011 | Lin | A47C 19/021 5/9.1 |
| 2014/0259396 | A1 * | 9/2014 | McCarty | A47C 19/005 5/400 |
| 2019/0000236 | A1 * | 1/2019 | Polevoy | A47C 19/02 |

* cited by examiner

BED FRAME ASSEMBLED BY SLIDING THE ENDS OF METAL BARS INTO SLOTS CUT INTO OTHER METAL BARS

CROSS REFERENCE TO RELATED APPLICATION

This application is a continuation of, and claims priority under 35 U.S.C. § 120 from, nonprovisional U.S. patent application Ser. No. 15/609,067 entitled "Bed Frame Assembled By Sliding the Ends of Hollow Metal Bars Into Narrow Slots Cut Into Other Metal Bars," filed on May 31, 2017, now U.S. Pat. No. 10,362,879, the subject matter of which is incorporated herein by reference.

TECHNICAL FIELD

The described embodiments relate to bedding products, and more particularly to a metal bed frame and a mattress supporting system.

BACKGROUND INFORMATION

Conventional bed frames are relatively heavy and awkward. FIG. 1 (prior art) shows the structure of a conventional bed frame 10 including two opposing side rails 11 with a plurality of cross bar members 12 extending between the side rails. Bed frame 10 also includes a center beam 13 that is parallel to the side rails and located at the center of the bed frame in order to provide additional support to a box spring and mattress. The side rails 11 and cross bar members 12 are typically formed from elongated pieces of steel having an L-shaped cross-section (also called angle iron). A horizontal flange of each side rail 11 supports the box spring, and a vertical flange prevents each side rail from bending under the weight of the box spring, the mattress and the occupants of the bed. Thus, the angular arrangement of the side rails is required for structural integrity. Edge attachments 14 are screwed to the ends of the side rails 11 to prevent the box spring from sliding past the head of the bed frame 10. The edge attachments 14 have sharp metal edges located at the level of the shins of persons walking around the bed frame 10, for example during assembly. In addition, downwardly extending support legs typically screw into threaded leg holders attached to cross bar members 12, center beam 13 and/or side rails 11. The bed frame 10 may support the box spring on loose wooden slats spanning between the side rails or may directly accommodate the box spring.

Conventional bed frames are typically assembled at the location of the bed. The assembly process can be cumbersome because it usually involves many non-intuitive steps and requires the use of multiple tools. The manner in which multiple pieces are connected to form the cross bar members 12 is typically complicated and can require tools. In addition, the support legs must be screwed or bolted to the cross bar members 12 or side rails 11. Another shortcoming of conventional bed frames is the relatively heavy weight, due primarily to the weight of the angle irons from which side rails 11 and cross bar members 12 are made. The heavy weight results in higher shipping costs and difficulty of assembly.

Thus, a light-weight bed frame is sought that is less complicated to assemble and does not require tools to connect the components. The easily assembled bed frame should nevertheless be sturdy and should not creek under the weight of the occupants. In addition, the components of the bed frame should compactly fit inside a shipping box.

SUMMARY

A novel bed frame assembly is easily assembled without tools by sliding the ends of hollow metal bars into narrow slots that are cut into other hollow metal bars using laser cutting. No connectors need be welded to the ends of the bars. The bed frame assembly for supporting a mattress includes lateral bars, longitudinal bars, support legs and thinner mattress support bars. All of the bars have rectangular cross sections. A first hollow bar has a first L-shaped slot. A second hollow bar has a second U-shaped slot and a third L-shaped slot both spanning two adjacent sides of the second bar. The first end of the first hollow bar is adapted to be inserted into the second U-shaped slot, whose width is less than twice the thickness of the metal from which the first hollow bar is made. A portion of the first L-shaped slot aligns with a portion of the third L-shaped slot when the first hollow bar is slid into the second U-shaped slot. The third L-shaped slot in the second hollow bar has a width that is less than twice the thickness of the metal from which a third hollow bar is made. A side of the third hollow bar at the top end is adapted to slide into the aligned portions of the first slot and the third slot. The first bar is a longitudinal bar, and the second bar is a lateral bar of the bed frame. The third bar is a support leg. Three bars are also connected in an analogous manner at the other three corners of the bed frame assembly.

A method of assembling the bed frame assembly starts with the user removing two longitudinal bars, two lateral bars, four support legs, twelve mattress support bars and user instructions from the packing box. All of the bars are hollow and have a rectangular cross section. The user begins to assemble the bed frame assembly by inserting a first end of a first bar having a first slot into a second slot of a second bar. The second slot is cut into two adjacent sides of the second bar. A third slot is disposed in the same two adjacent sides of the second hollow bar. The first bar is made from metal having a first thickness. The second slot has a first width that less than twice the first thickness. After the first end of the first bar is inserted into the second slot of the second bar, a portion of the first slot aligns with a portion of the third slot.

In a next step, a top end of a third bar is inserted into both the first slot of the first bar and the third slot of the second bar. A side of the third bar at the top end is disposed in the aligned portions of the first slot and the third slot after the top end of the third bar is inserted into both the first slot and the third slot. The third hollow bar is made from metal having a second thickness. The third slot has a second width that is less than twice the second thickness.

In a next step, lateral mattress support bars are attached to the first bar. The lateral bars are parallel to the second bar when the lateral bars are attached to the first bar. In one embodiment, the first bar is a longitudinal bar, and the second bar is a lateral bar of the bed frame assembly. The third bar is a support leg. The lateral mattress support bars span between the first bar and a second longitudinal bar that is parallel to the first bar. In another step, a mattress is placed over the lateral mattress support bars.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 1:
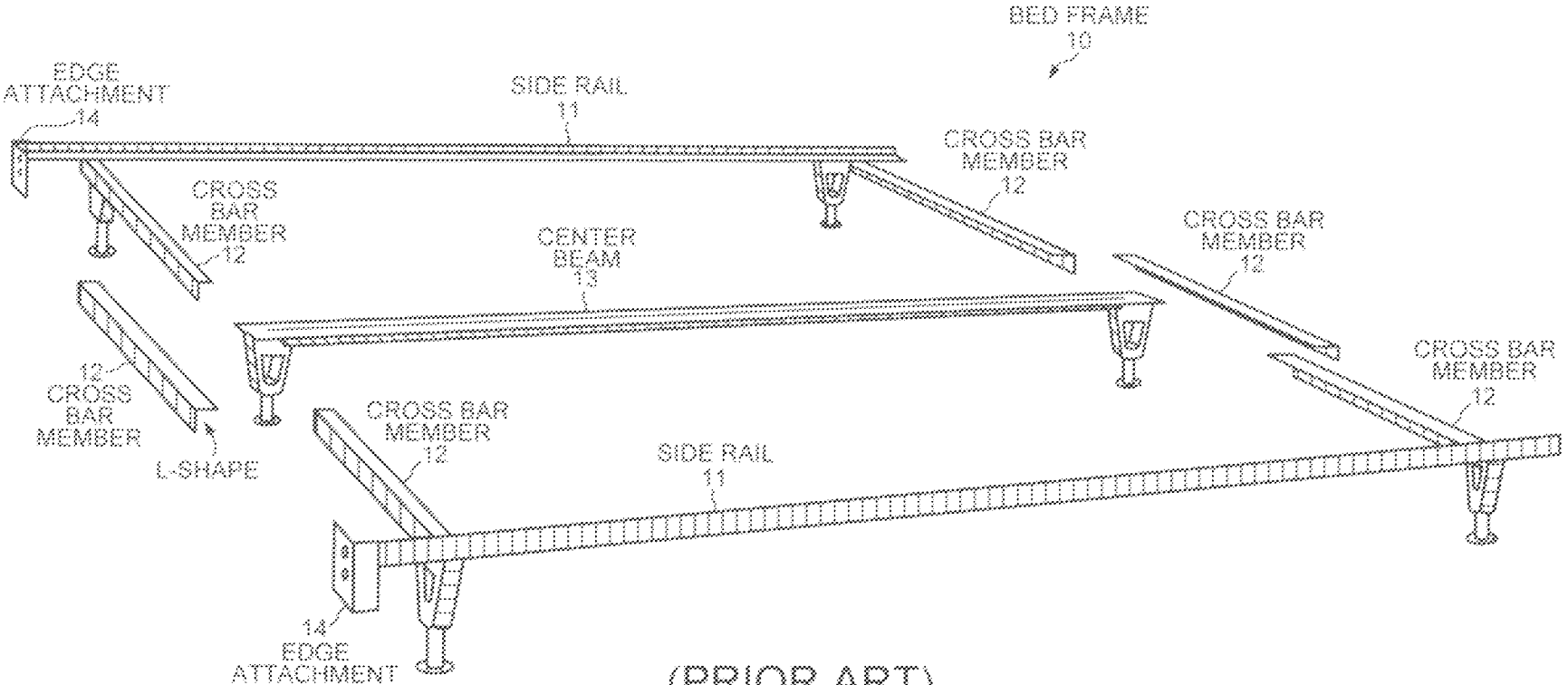
(PRIOR ART) FIG. 1
FIG. 1 (prior art) is a perspective view of a prior art bed frame with each rail having an L-shaped cross section.
Figure 2:
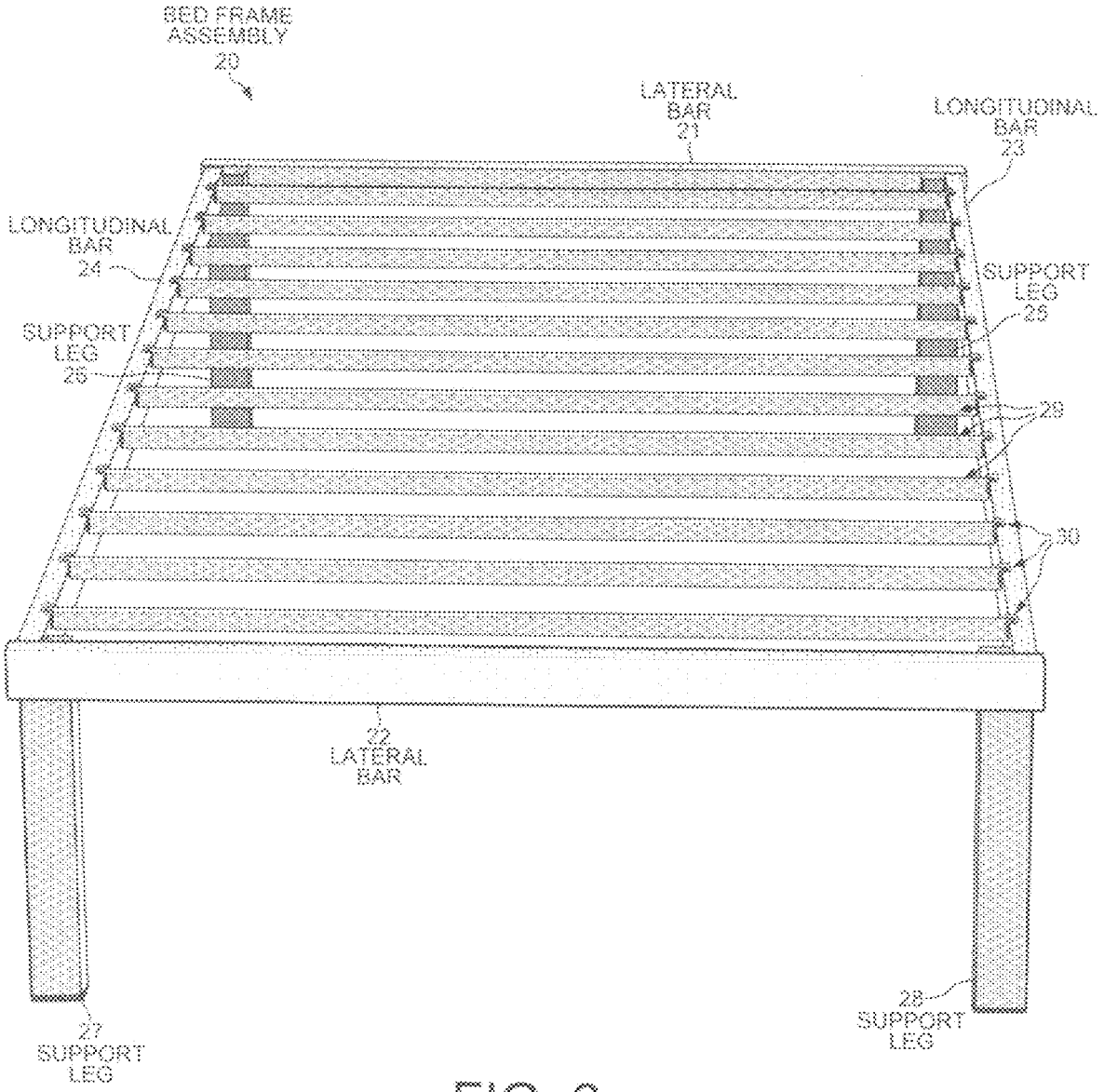
FIG. 2 is a perspective view of a novel bed frame that is easily assembled by inserting the ends of hollow metal bars into slots cut into other metal bars.

FIG. 2 is a perspective view of a novel bed frame assembly 20 that can easily be assembled without tools by sliding the ends of hollow metal bars into narrow slots that are cut into other hollow metal bars. The components of bed frame assembly 20 can be inexpensively manufactured because no connectors need be welded to the ends of the bars in order to permit the bars to be attached to one another. Thus, the cost of welding is avoided. The connecting slots are cut into the metal bars using a focused laser beam.

Bed frame assembly 20 is a mattress supporting system upon which a mattress can be directly placed without any intervening box springs. Bed frame assembly 20 is light weight but nevertheless sturdy. Most important, bed frame assembly 20 can easily be assembled without using tools. FIG. 2 shows a twin sized version of the mattress supporting system. However, the queen and king sized versions can be made using the same inventive concepts. Bed frame assembly 20 is made using only eight larger metal components as well as a varying number of smaller metal bars upon which the mattress rests. The embodiment of FIG. 2 includes twelve smaller metal bars that support the mattress. The queen sized version of bed frame assembly 20 is also made from just eight larger metal pieces, as well as more than twelve smaller mattress support bars. The king sized version includes an additional larger longitudinal or lateral bar that spans the middle of the bed frame and that is supported by a leg support in the middle.

In the description and claims, terms such as "upper", "lower", "top", "bottom", "up", and "down" are used to describe relative directions and orientations between different parts of the mattress supporting system, and it is to be understood that the overall structure being described can actually be oriented in any way in three-dimensional space. For example, when a first object is described as being inserted up into a second object, it is to be understood that the first object may in fact be inserted down into the second object. When a first object is referred to as being disposed "over" or "on" a second object, it is to be understood that the first object can be directly on the second object, or an intervening object may be present between the first and second objects.

Bed frame assembly 20 includes two lateral bars 21-22, two longitudinal bars 23-24 and four support legs 25-28. The longitudinal bars 23-24 form the side rails of the mattress support 20. In addition, bed frame assembly 20 includes twelve smaller mattress support bars 29 that span between the two longitudinal bars 23-24. The ends of the smaller mattress support bars 29 fit into plastic receptacles 30 that are inserted into cutout portions on the inner sides of the longitudinal bars 23-24. The cutout portions are sufficiently deep on the inner sides of the longitudinal bars 23-24 to allow the bars 29 to fit down into the plastic receptacles 30 such that the upper surfaces of the smaller mattress support bars 29 are below the top sides of the longitudinal bars 23-24 and below the upper sides of the lateral bars 21-22. The tops of the longitudinal and lateral bars for a lip around the upper surfaces of the smaller mattress support bars 29 on which the mattress rests. This lip holds the mattress in place and prevents the mattress from sliding past the head or foot of the bed frame without using any edge attachments attached to the longitudinal bars.

All of the lateral and longitudinal bars 21-24, support legs 25-28 and mattress support bars 29 are made from hollow metal bars with rectangular cross sections. The hollow, rectangular metal construction of the bars provides a stronger structure with less weight. The hollow, rectangular metal bars provide stronger structures than would solid bars of the same weight of metal.

Figure 3:
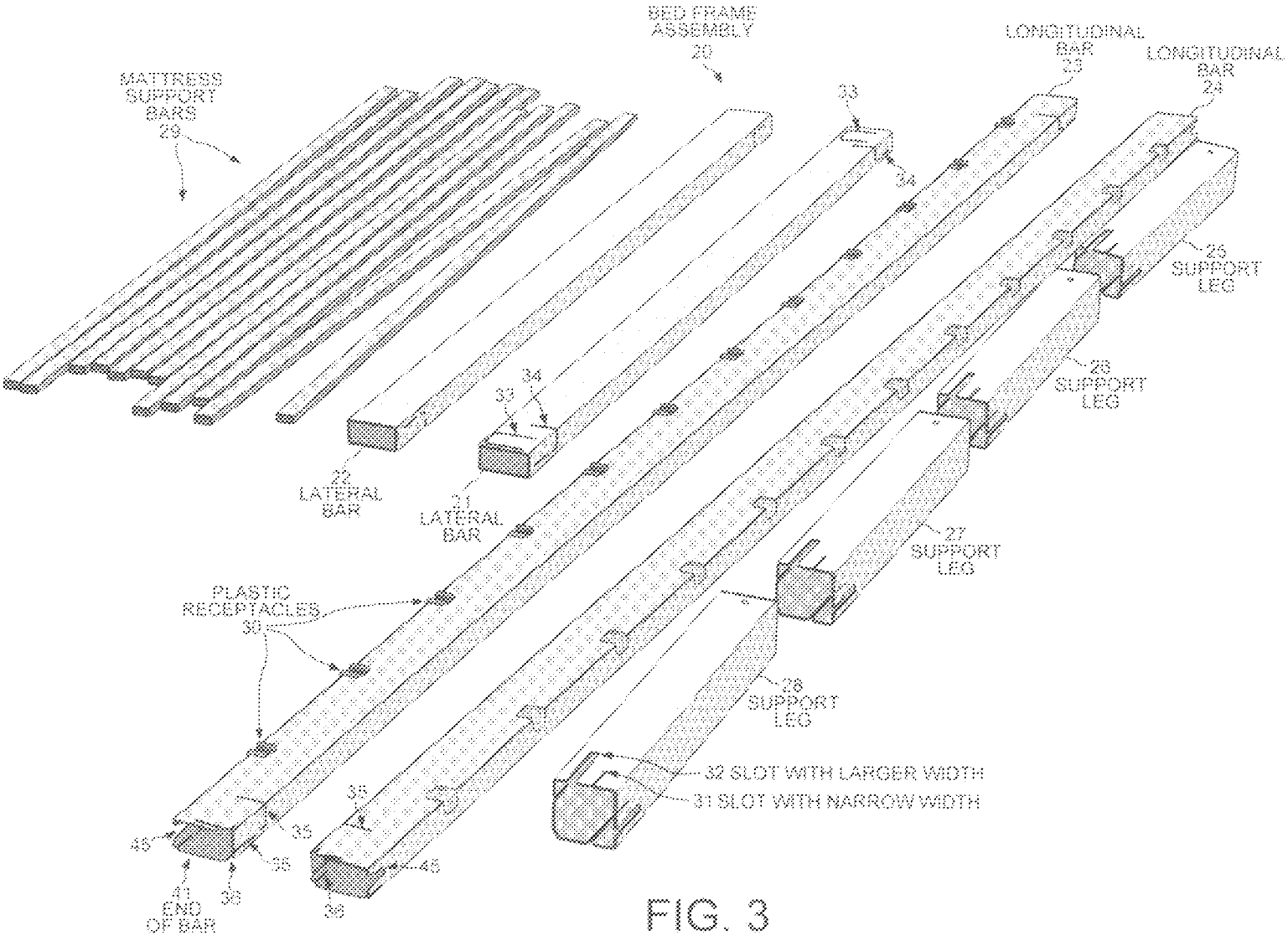
FIG. 3 shows the bed frame of FIG. 2 in an unassembled state such as how the components would appear when a user first removes them from a packing box.

FIG. 3 shows bed frame assembly 20 in an unassembled state such as how the components would appear when the user first removes them from the packing box. FIG. 3 shows that each support leg 25-28 is a hollow metal bar with a square cross section. A square plug fits into the end of each support leg that rests on the ground. The opposite end of each support leg 25-28 is open and has six slots cut lengthwise into the open end. Four of the slots 31 have a narrow width, and two of the slots 32 have a larger width.

Each of the lateral and longitudinal bars 21-24 is also a hollow metal bar that has a rectangular cross section. Each of the lateral bars 21-22 also has slots cut into the metal near both ends of each bar. For example, the first lateral bar 21 has a U-shaped slot 33 and an L-shaped slot 34 cut into the sides of the bar towards each end of the bar 21. The U-shaped slots 33 are cut into the wider sides of the lateral bars 21-22, while the L-shaped slots 34 traverse both the wider and the narrower side of each lateral bar 21-22. Thus, the L-shaped slots 34 are cut into two adjacent sides of the lateral bars 21-22. The U-shaped slots near the ends of the second lateral bar 22 are not visible in FIG. 3 because the U-shaped slots are made in the side of the bar 22 that is facing the ground.

FIG. 3 also shows that each of the longitudinal bars 23-24 also has slots cut into the metal near both ends of each bar. However, there are no U-shaped slots in the longitudinal bars 23-24. The U-shaped slots 33 in the lateral bars 21-22 allow the ends of the longitudinal bars 23-24 to be inserted into the wider sides of the lateral bars 21-22. No end of a bar is inserted into the wider sides of the longitudinal bars 23-24, so no U-shaped slots are needed in the longitudinal bars 23-24. L-shaped slots 35 are cut into two adjacent sides near the ends of the longitudinal bars 23-24. Thus, each L-shaped slot is cut into a wider side and a narrower side of the bar. In addition, a length-wise slot 36 is cut into each end of each longitudinal bar 23-24. FIG. 3 also shows the twelve smaller mattress support bars 29 whose ends fit into the plastic receptacles 30 in the longitudinal bars 23-24.

Figure 4A:
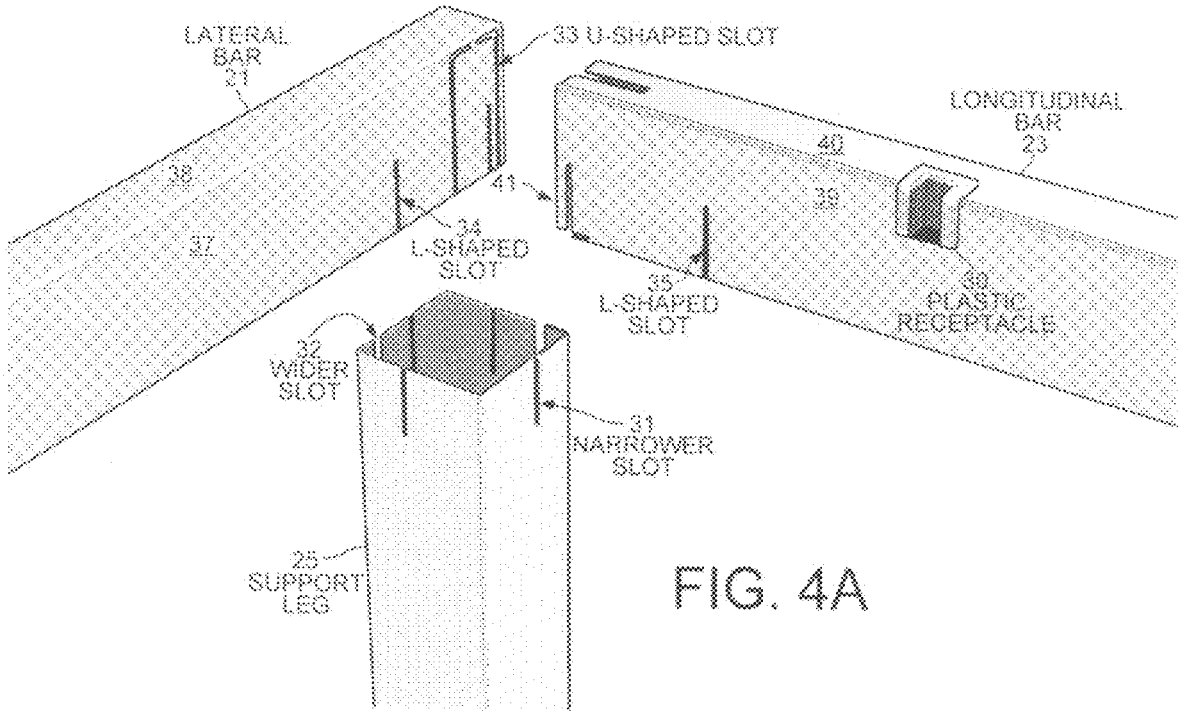
FIG. 4A shows the ends of a lateral bar, a longitudinal bar and a support leg of the bed frame of FIG. 2 that are to be attached together.

FIG. 4A is a more detailed view of the ends of lateral bar 21, longitudinal bar 23 and support leg 25 and illustrates how these bars are attached together. The user begins assembling bed frame assembly 20 by inserting longitudinal bar 23 into lateral bar 21 and then by inserting support leg 25 into the connected longitudinal and lateral bars. FIG. 4A shows the slots in the ends of lateral bar 21, longitudinal bar 23 and support leg 25 in more detail. The upper end of support leg 25 is an open end of a hollow metal bar with a square cross section. Six slots are cut length-wise into the open end. There are four narrower slots 31 and two wider slots 32. Lateral bar 21 is a hollow metal bar with a rectangular cross section. FIG. 4A shows an inner wider side 37 and an upper narrower side 38 of lateral bar 21, as well as an inner wider side 39 and an upper narrower side 40 of longitudinal bar 23. A U-shaped slot 33 is cut into the wider side 37 near the end of lateral bar 21. The U-shaped slot 33 has a shape corresponding to a portion of the rectangular cross section of longitudinal bar 23. The user begins assembling bed frame assembly 20 by inserting a first end 41 of longitudinal bar 23 into the U-shaped slot 33 of lateral bar 21. Longitudinal bar 23 is made from metal having a first thickness. The U-shaped slot 33 has a width that is greater than the first thickness but less than twice the first thickness. The narrow width of the U-shaped slot 33 allows the first end 41 of longitudinal bar 23 to fit snugly into the slot. The narrow slots are cut into the sides of the bars using a laser cutting.

Figure 4B:
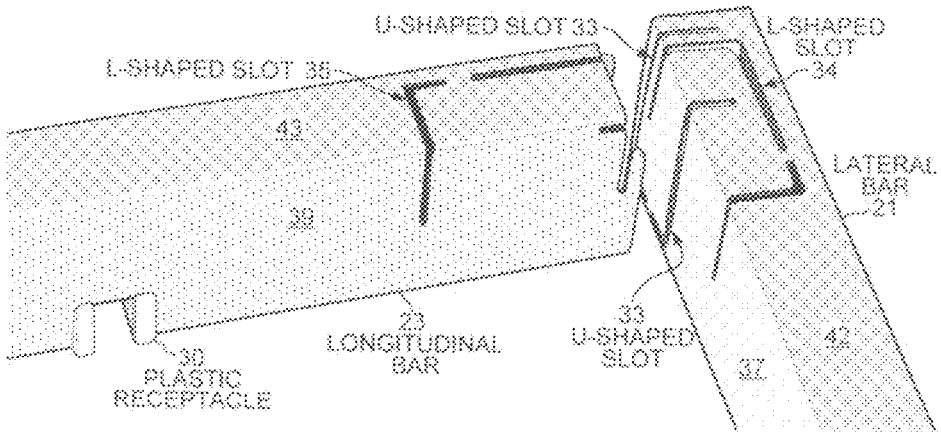
FIG. 4B shows the ends of the lateral bar and longitudinal bar of FIG. 4A viewed from below.

FIG. 4B shows the ends of lateral bar 21 and longitudinal bar 23 looking from underneath. The U-shaped slot 33 is disposed in two adjacent sides of the lateral bar 21. In addition to being cut into the inner wider side 37, U-shaped slot 33 is also cut into the bottom narrower side 42. This permits the wider sides of the longitudinal bar 23 to be inserted farther into the lateral bar 21. FIG. 4B also shows the bottom narrower side 43 of longitudinal bar 23. The L-shaped slot 35 is cut into the adjacent sides 39 and 43 of longitudinal bar 23.

Figure 4C:
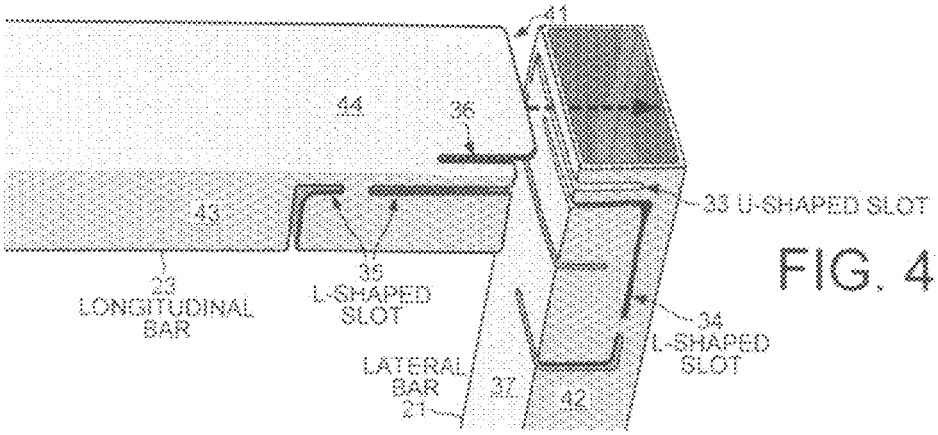
FIG. 4C shows the bottoms of the lateral and longitudinal bars of FIG. 4A as well as the outer wider side of the longitudinal bar.

FIG. 4C illustrates lateral bar 21 and longitudinal bar 23 from underneath showing the outer wider side 44 of longitudinal bar 23. FIG. 4C illustrates how the first end 41 of longitudinal bar 23 is inserted into the U-shaped slot 33 of lateral bar 21 until the end of the outer wider side 44 touches the opposite side of lateral bar 21. The length-wise slot 36 in longitudinal bar 23 aligns with the portion of the U-shaped slot 33 on the bottom narrower side 42 of lateral bar 21 and allows the first end 41 of longitudinal bar 23 to be inserted past the end of the U-shaped slot 33.

Figure 5:
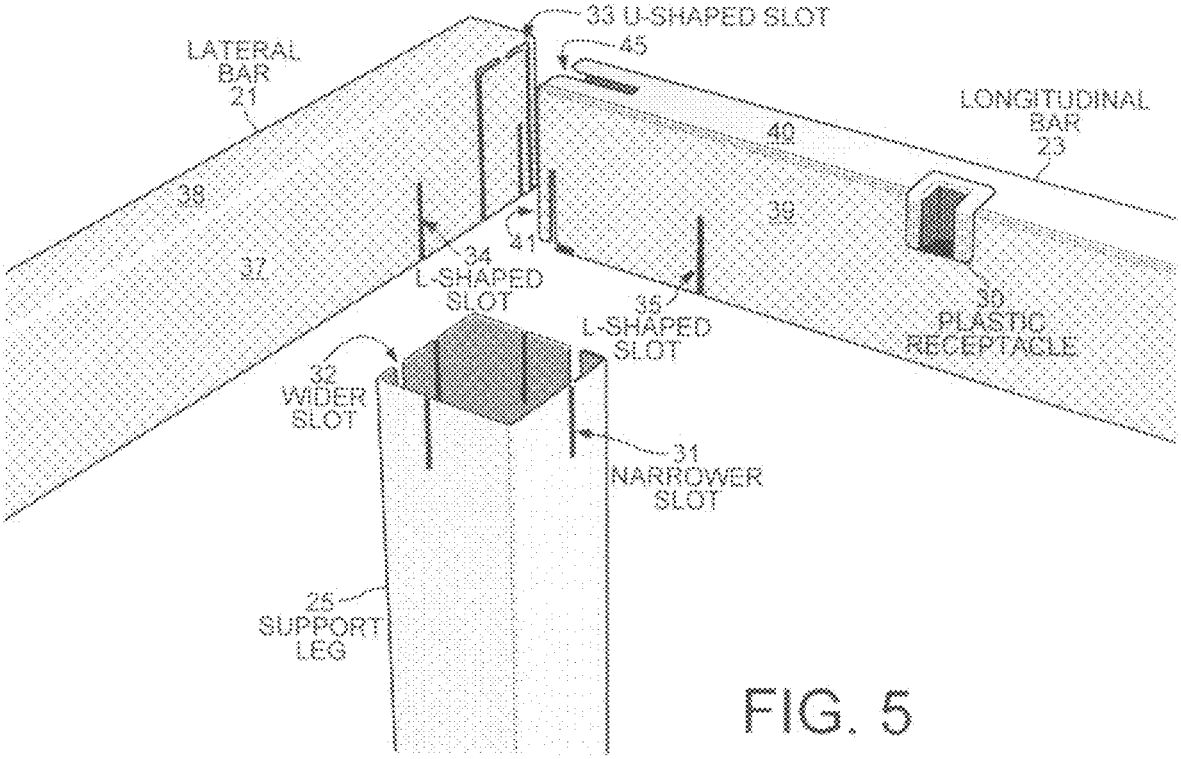
FIG. 5 shows the longitudinal bar of FIG. 4A positioned closer to a U-shaped slot in the lateral bar.

FIG. 5 shows the first end 41 of longitudinal bar 23 positioned closer to the U-shaped slot 33 in lateral bar 21. A wider slot 45 in the end of the upper narrower side 40 allows the longitudinal bar 23 to slide past the uncut portion at the bottom of the "U" of U-shaped slot 33 in lateral bar 21.

Figure 6:
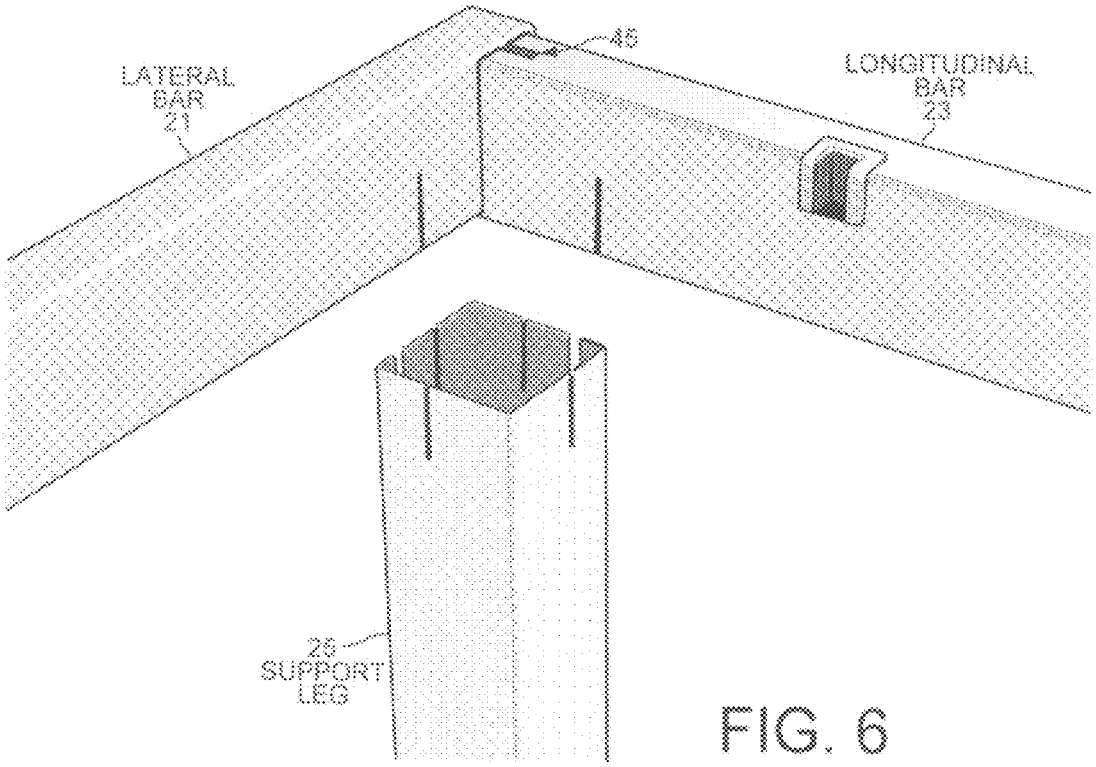
FIG. 6 shows a stage of connecting the longitudinal bar to the lateral bar in which the end of the longitudinal bar is partially inserted into the U-shaped slot in the lateral bar.

FIG. 6 shows the first end 41 of longitudinal bar 23 having been partially inserted into the U-shaped slot 33 in lateral bar 21. A portion of the wider slot 45 in the upper narrower side 40 of longitudinal bar 23 is still visible.

Figure 7:
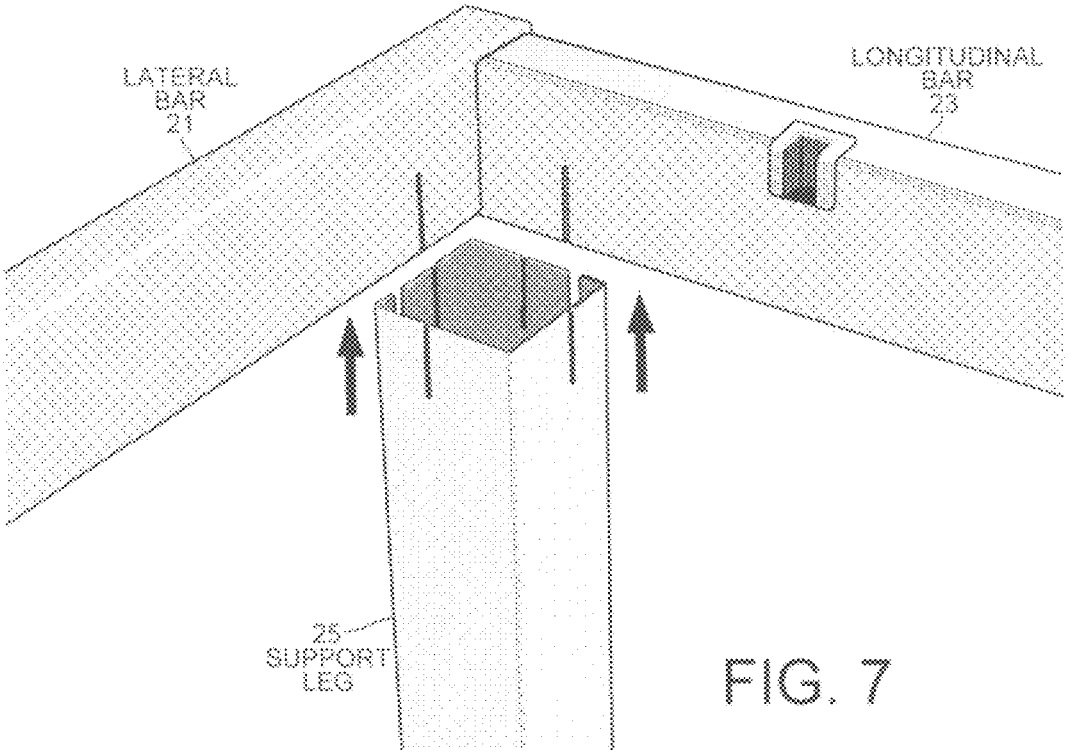
FIG. 7 shows the end of the longitudinal bar completely inserted into the U-shaped slot in the lateral bar.

FIG. 7 shows the first end 41 of longitudinal bar 23 completely inserted into the U-shaped slot 33 in lateral bar 21. Longitudinal bar 23 is perpendicular to lateral bar 21 when the first end 41 of the longitudinal bar is fully inserted into the U-shaped slot 33.

Figure 8:
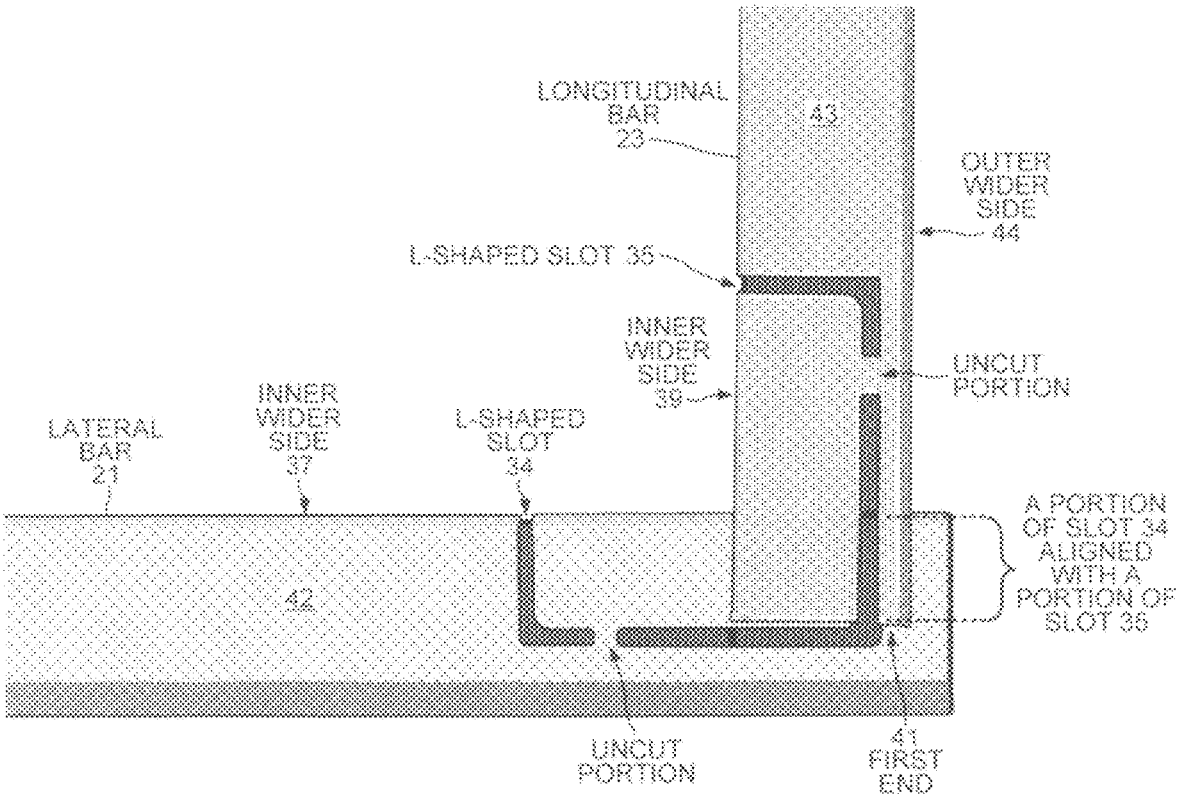
FIG. 8 shows the bottom sides of the longitudinal and lateral bars after the end of the longitudinal bar has been fully inserted into the lateral bar.

FIG. 8 shows the bottom narrower side 43 of longitudinal bar 23 and the bottom narrower side 42 of lateral bar 21 after the first end 41 of longitudinal bar 23 is fully inserted into lateral bar 21. The outer wider side 44 of longitudinal bar 23 is longer than the bottom narrower side 43 (see FIG. 4C) and abuts the opposite side of lateral bar 21 when longitudinal bar 23 is completely inserted. The end of the bottom narrower side 43 is thereby prevented from covering the L-shaped slot 34 cut in the bottom narrower side 42 of lateral bar 21. When longitudinal bar 23 is completely inserted, a portion of the L-shaped slot 35 in longitudinal bar 23 aligns with a portion of the L-shaped slot 34 in lateral bar 21. The aligned L-shaped slots 34-35 form a shape with dimensions that correspond to a portion of the square cross section of support leg 25. The sides of the upper open end of support leg 25 are adapted to slide into the aligned portions of the slots 34-35. The four narrower slots 31 cut length-wise in the open end of support leg 25 fit over portions of the inner wider sides 37, 39 at the ends of the slots 34-35. The two wider slots 32 in the support leg 25 fit over the uncut portions of the bottom narrower sides 42-43 along the slots 34-35.

Figure 9:
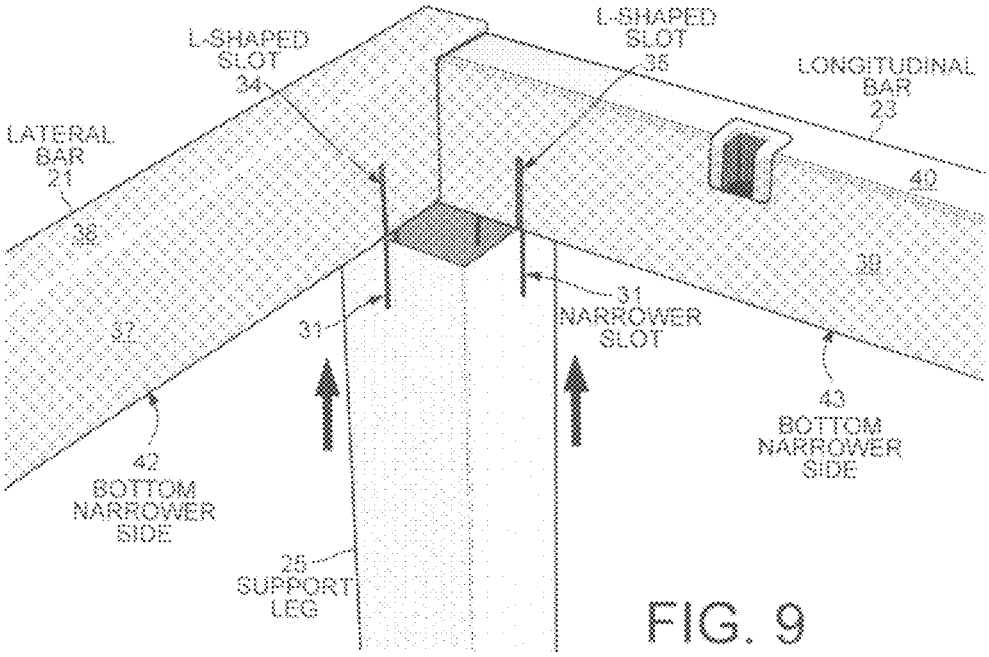
FIG. 9 shows a stage in connecting the support leg to the longitudinal and lateral bars in which the upper end of the support leg is being inserted into aligned L-shaped slots in the bottoms of the longitudinal and lateral bars.

FIG. 9 shows the first end 41 of longitudinal bar 23 completely inserted into the U-shaped slot 33 in lateral bar 21 and the open end of support leg 25 being inserted into the aligned L-shaped slots 34-35 in the bottom narrower sides 42-43 of the connected lateral and longitudinal bars 21 and 23. The sides of the open end of support leg 25 are adapted to slide into the aligned portions of the L-shaped slots 34-35. Portions of the L-shaped slots 34-35 in lateral and longitudinal bars 21, 23 fit into the narrower slots 31 in support leg 25 and allow the end of the support leg to be inserted into the connected bars 21, 23 a greater distance than the length of the narrower slots 31.

Figure 10:
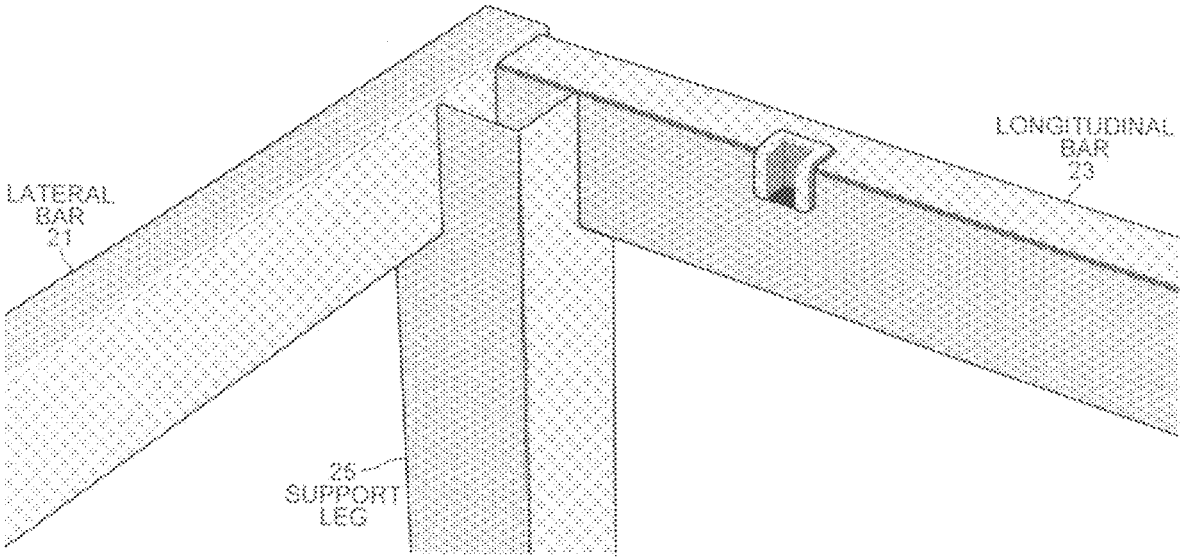
FIG. 10 shows the upper end of the support leg completely inserted into the aligned L-shaped slots in the bottom sides of the connected longitudinal and lateral bars.

FIG. 10 shows the upper end of support leg 25 completely inserted into the aligned L-shaped slots 34-35 in the bottom narrower sides 42-43 of the connected lateral and longitudinal bars 21 and 23. When the support leg 25 is inserted into the aligned slots 34-35 of the connected lateral and longitudinal bars 21 and 23, the support leg 25 is perpendicular to both lateral bar 21 and longitudinal bar 23. The first end 41 of longitudinal bar 23 is prevented from being removed from the U-shaped slot 33 in lateral bar 21 when support leg 25 is inserted into the aligned slots 34-35.

Figure 11:
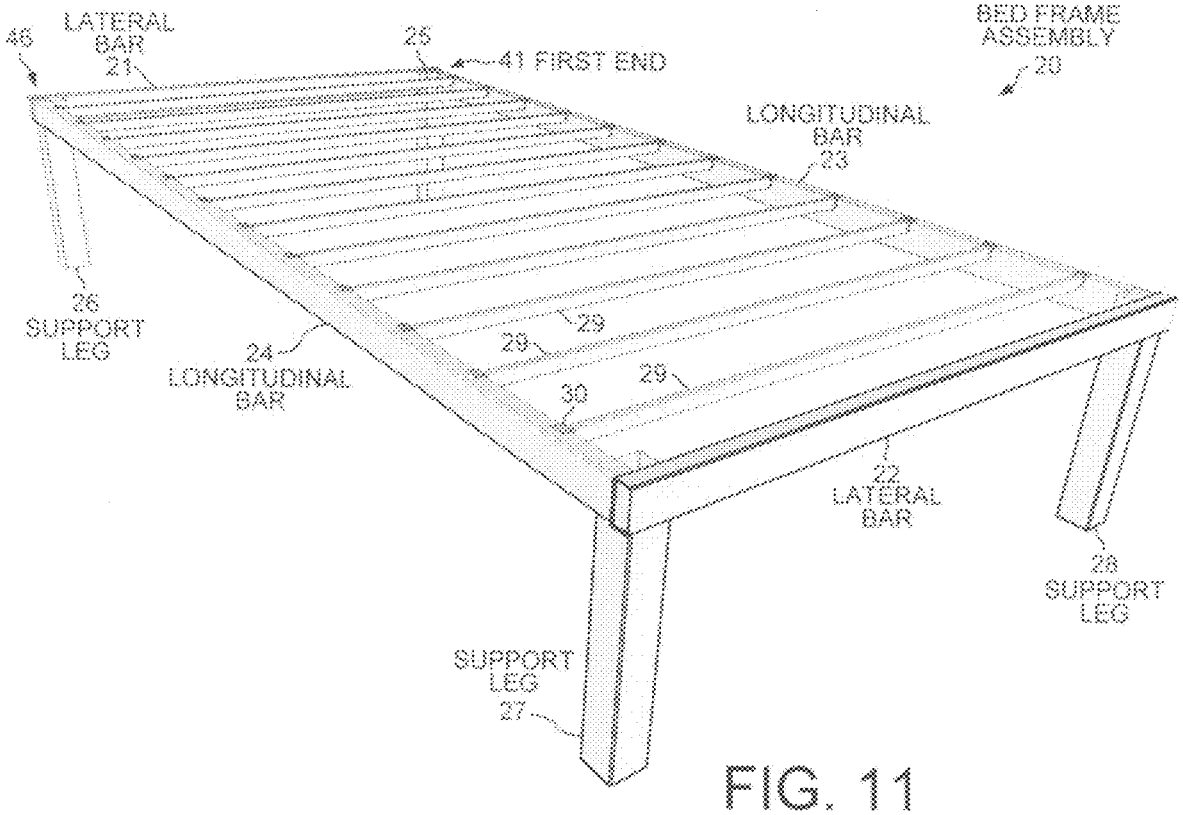
FIG. 11 is a perspective view of the bed frame in a completely assembled state.

FIG. 11 shows bed frame assembly 20 in a completely assembled state. After the first end 41 of longitudinal bar 23 is inserted into an end of lateral bar 21 and support leg 25 is inserted into the connected bars 21 and 23, an end 46 of the other longitudinal bar 24 is inserted into the other end of lateral bar 21 in an analogous manner. Then support leg 26 is inserted into the intersection of the connected bars 21 and 24. The opposite ends of longitudinal bars 23-24 are then inserted into U-shaped slots at the two ends of lateral bar 22.

Finally, the support legs 27-28 are inserted into the aligned L-shaped slots at the intersections of lateral bar 22 and the longitudinal bars 23-24.

For easier assembly, the lateral and longitudinal bars can be connected upside down, and the support legs can be inserted down into the aligned L-shaped slots. Then the frame can be turned right side up before the mattress support bars 29 are positioned between the longitudinal bars 23-24. The ends of the mattress support bars 29 are pressed snugly down into the plastic receptacles 30 and are held by friction.

Figure 12:
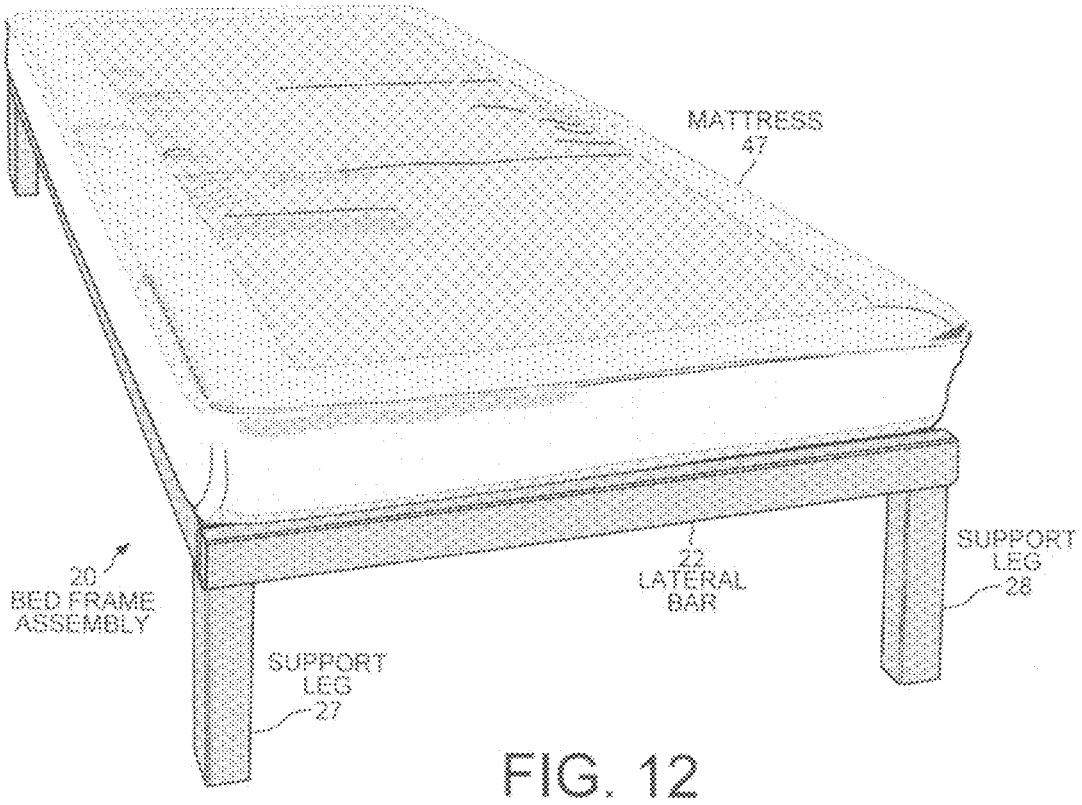
FIG. 12 shows the bed frame in an assembled state supporting a mattress without an intervening box spring.

FIG. 12 shows bed frame assembly 20 in an assembled state supporting a mattress 47. The mattress 47 rests on the mattress support bars 29. The mattress 47 is placed directly on bed frame assembly 20 without any intervening box springs. Although FIG. 12 shows a twin sized version of the bed frame assembly 20, queen and king sized versions can be made using the same slot connections that do not require welding.

Although the frame assembly of FIG. 12 is used to support a mattress, the frame assembly can also support a table top or a seat top for a bench, stool or chair. When the frame assembly is a table, the legs 25-28 are longer than when the frame assembly is a bed or a bench. The table top is dimensioned to fit inside the rectangle formed by the lateral and longitudinal bars 21-24 and rests on the support bars 29. The support bars 29 to fit down into the plastic receptacles 30 sufficiently far such that the upper surfaces of the support bars 29 are below the top sides of the lateral and longitudinal bars 21-24. This permits the table top to be flush with the top sides of the lateral and longitudinal bars.

Figure 13:
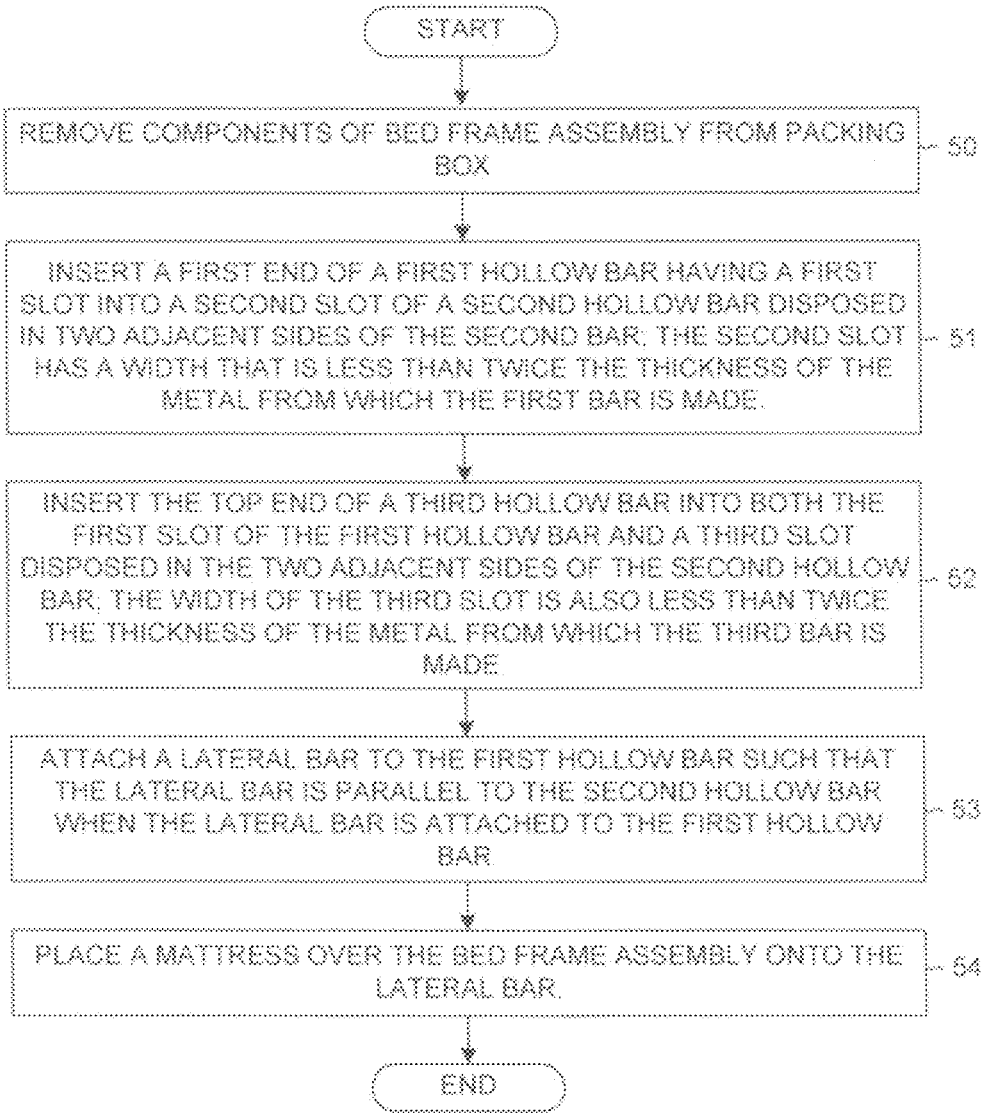
FIG. 13 is a flowchart illustrating the steps of a method of assembling the bed frame of FIGS. 2 and 11.

FIG. 13 is a flowchart illustrating the steps 50-53 of the method of assembling bed frame assembly 20. The steps 50-53 of the method of FIG. 13 are described in relation to the components of bed frame assembly 20 shown in FIGS. 5 and 8. In a first step 50, the components of frame assembly 20 are removed from the packing box and appear as shown in FIG. 3. The user instructions are also removed from the packing box. Alternatively, the bed frame assembly 20 is assembled at the factory before being put in a packing box in order to ensure that all of the components fit each other properly.

In a next step 51, a first end 41 of a first hollow bar 23 having a first slot 35 is inserted into a second slot 33 of a second hollow bar 21. For example, the first end 41 of a first longitudinal bar 23 with the first L-shaped slot 35 is inserted into the U-shaped slot 33 cut into the lateral bar 21. The first hollow bar 23 has a rectangular cross section and is made from metal having a first thickness. The second hollow bar 21 also has a rectangular cross section. The second slot 33 is disposed in two adjacent sides 37 and 42 of the second hollow bar 21. The second slot 33 has a first width that less than twice the first thickness. A third L-shaped slot 34 is disposed in the two adjacent sides 37 and 42 of the second hollow bar 21.

In a step 52, the top end of a third hollow bar 25 is inserted into both the first slot 35 of the first hollow bar 23 and the third slot 34 of the second hollow bar 21. After the first end 41 of the first hollow bar 23 has been inserted into the second slot 33 of the second hollow bar 21, a portion of the first slot 35 aligns with a portion of the third slot 34 such that a side of the third hollow bar 25 at the top end is disposed in the aligned portions of the first slot 35 and the third slot 34 after the top end of the third hollow bar 25 is inserted into both the first slot 35 and the third slot 34. The third hollow bar 25 has a rectangular cross section and is made from metal having a second thickness. The third slot 34 has a second width that is less than twice the second thickness. For example, the third hollow bar 25 is the support leg 25, which has a square cross section. The top end of support leg 25 is inserted both into the L-shaped slot 35 of the longitudinal bar 23 and into the aligned L-shaped slot 34 of the lateral bar 21.

Steps 51-52 are repeated three additional times for support legs 26-28. For support leg 26, a first end 46 of longitudinal bar 24 is inserted into a second U-shaped slot at the opposite end of lateral bar 21 so as to align L-shaped slots cut in the bars 24 and 21. Then the top end of support leg 26 is inserted into both an L-shaped slot in longitudinal bar 24 and an aligned L-shaped slot in lateral bar 21. An analogous procedure is performed to attach support leg 27 to the intersection of bars 24 and 22 and to attach support leg 28 to the intersection of bars 23 and 22.

In a step 53, a lateral mattress support bar 29 is attached to the first hollow bar 23 such that the lateral bar 29 is parallel to the second hollow bar 21 when the lateral bar 29 is attached to the first hollow bar 23. For example, the twelve mattress support bars 29 are attached at opposite ends to both longitudinal bars 23-24 by being pressed down into the plastic receptacles 30.

In a step 54, a mattress 47 is placed over the lateral mattress support bars 29. In the embodiment of FIG. 12, a twin sized mattress 47 is placed over the bed frame assembly 20 onto the lateral mattress support bars 29. In another embodiment, a table top is placed over the lateral support bars 29 in order to make a table. In yet another embodiment, a cushioned seat for a bench, stool or chair is placed over the support bars 29.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A apparatus comprising:

a first hollow bar having a first end and a first slot;

a second hollow bar having a second slot disposed in two adjacent sides of the second hollow bar, wherein a third slot is disposed in the two adjacent sides of the second hollow bar, wherein the first end of the first hollow bar is adapted to be inserted into the second slot, and wherein a portion of the first slot is aligned with a portion of the third slot when the first end of the first hollow bar is fully inserted into the second slot; and a third hollow bar with a top end, wherein the third hollow bar is made from metal having a first thickness, wherein the third slot has a second width that is greater than the first thickness but less than twice the first thickness, and wherein the top end of the third hollow bar is adapted to be inserted into the first slot and the third slot after the first end of the first hollow bar has been fully inserted into the second slot.

2. The apparatus of claim 1, wherein a portion of the first slot aligns with a portion of the third slot when the first hollow bar is slid into the second slot, and wherein a side of the third hollow bar at the top end is adapted to slide into the aligned portions of the first slot and the third slot.

3. The apparatus of claim 1, wherein the third hollow bar has sides that form a cross-sectional shape, and wherein the first slot and the third slot form a slot shape having dimensions that correspond to a portion of the cross-sectional shape after the first end of the first hollow bar has been fully inserted into the second slot.

4. The apparatus of claim 1, wherein the apparatus is taken from the group consisting of: a bed, a table, a seat, a bench, a stool and a chair.

5. The apparatus of claim 1, wherein the first end of the first hollow bar is prevented from being removed from the second slot by the top end of the third hollow bar being inserted into the first slot and the third slot.

6. The apparatus of claim 1, wherein the first hollow bar is perpendicular to the second hollow bar when the first end of the first hollow bar is inserted into the second slot in the second hollow bar.

7. The apparatus of claim 6, wherein the third hollow bar is perpendicular to both the first hollow bar and the second hollow bar when the top end of the third hollow bar is inserted into the first slot in the first hollow bar and the third slot in the second hollow bar.

8. The apparatus of claim 1, wherein the third hollow bar is a leg of the apparatus, and wherein the first hollow bar is a side rail of the apparatus.

9. The apparatus of claim 8, wherein the first hollow bar is adapted to support lateral bars of the apparatus, further comprising:

a mattress, wherein the mattress is disposed on the lateral bars.

10. A support frame comprising:

a first hollow bar having sides with a first thickness, a first end and a first slot;

a second hollow bar having a second slot that is cut into two adjacent sides of the second hollow bar, wherein the second slot has a first width that is less than twice the first thickness, wherein a third slot is cut into the two adjacent sides of the second hollow bar, and wherein the second slot is adapted to receive the first end of the first hollow bar; and a third hollow bar having sides with a second thickness and a top end, wherein the third slot has a second width that is less than twice the second thickness, and wherein the first slot and the third slot are together adapted to receive the top end of the third hollow bar.

11. The support frame of claim 10, wherein the first hollow bar has a cross-sectional shape, and wherein the second slot has a shape corresponding to a portion of the cross-sectional shape.

12. The support frame of claim 10, wherein the first end of the first hollow bar is adapted to slide into the second slot.

13. The support frame of claim 10, wherein top end of the third hollow bar is adapted to slide into the first slot and the third slot.

14. The support frame of claim 10, wherein a portion of the first slot aligns with a portion of the third slot when the first end of the first hollow bar is disposed in the second slot, and wherein a side of the third hollow bar at the top end is adapted to slide into the aligned portions of the first slot and the third slot when the first end of the first hollow bar is disposed in the second slot.

15. The support frame of claim 10, wherein the first end of the first hollow bar cannot be removed from the second slot when the top end of the third hollow bar is disposed in the first slot and the third slot.

16. The support frame of claim 10, wherein the first hollow bar is perpendicular to the second hollow bar when the first end of the first hollow bar is inserted into the second slot in the second hollow bar.

17. The support frame of claim 10, wherein the third hollow bar is a leg of the support frame, and wherein the support frame is a table.

18. A method of assembling a support frame, comprising:

inserting a first end of a first hollow bar having a first slot into a second slot of a second hollow bar, wherein the first hollow bar is made from metal having a first thickness, wherein the second slot is disposed in two adjacent sides of the second hollow bar, wherein the second slot has a first width that less than twice the first thickness, and wherein a third slot is disposed in the two adjacent sides of the second hollow bar; and inserting a top end of a third hollow bar into both the first slot of the first hollow bar and the third slot of the second hollow bar after the first end of the first hollow bar is inserted into the second slot of the second hollow bar, wherein the third hollow bar is made from metal having a second thickness, and wherein the third slot has a second width that is less than twice the second thickness.

19. The method of claim 18, further comprising:

attaching a lateral bar to the first hollow bar, wherein the lateral bar is parallel to the second hollow bar when the lateral bar is attached to the first hollow bar.

20. The method of claim 18, wherein after the first end of the first hollow bar is inserted into the second slot of the second hollow bar, a portion of the first slot aligns with a portion of the third slot, and wherein a side of the third hollow bar at the top end is disposed in the aligned portions of the first slot and the third slot after the top end of the third hollow bar is inserted into both the first slot and the third slot.

* * * * *